US008096080B2

(12) United States Patent
Pavlovic et al.

(10) Patent No.: US 8,096,080 B2
(45) Date of Patent: Jan. 17, 2012

(54) ADJUSTABLE WINDOW REGULATOR LIFTER PLATE ASSEMBLY FOR A VEHICLE WINDOW

(75) Inventors: Milos Pavlovic, Newmarket (CA); Nick Marando, Barrie (CA)

(73) Assignee: Magna Closures Inc., Newmarket (CA)

( * ) Notice: Subject to any disclaimer, the term of this patent is extended or adjusted under 35 U.S.C. 154(b) by 0 days.

(21) Appl. No.: 12/145,627

(22) Filed: Jun. 25, 2008

(65) Prior Publication Data

US 2009/0007494 A1 Jan. 8, 2009

Related U.S. Application Data

(60) Provisional application No. 60/947,959, filed on Jul. 4, 2007.

(51) Int. Cl.
*E05F 11/38* (2006.01)

(52) U.S. Cl. ..... 49/348; 49/374; 49/352; 49/349

(58) Field of Classification Search ..... 49/348, 49/349, 351, 371, 374
See application file for complete search history.

(56) References Cited

U.S. PATENT DOCUMENTS

| | | | | |
|---|---|---|---|---|
| 4,449,326 | A * | 5/1984 | Hori et al. | 49/375 |
| 4,759,653 | A * | 7/1988 | Maekawa et al. | 403/24 |
| 4,910,917 | A * | 3/1990 | Brauer | 49/348 |
| 5,622,005 | A * | 4/1997 | Ochenski et al. | 49/375 |
| 5,832,667 | A * | 11/1998 | Buening et al. | 49/212 |
| 5,950,365 | A * | 9/1999 | Lieb et al. | 49/28 |
| 6,202,351 | B1 * | 3/2001 | Medebach | 49/352 |
| 6,453,617 | B1 * | 9/2002 | Klippert et al. | 49/375 |
| 6,588,152 | B2 * | 7/2003 | Cabbane | 49/375 |
| 6,598,345 | B1 * | 7/2003 | Arimoto et al. | 49/374 |
| 6,854,213 | B2 | 2/2005 | Galliani et al. | |
| 6,966,149 | B2 * | 11/2005 | Fenelon | 49/375 |
| 2004/0045221 | A1 | 3/2004 | Oberheide et al. | |
| 2005/0235566 | A1 | 10/2005 | Fassbender | |
| 2005/0268558 | A1 * | 12/2005 | Cardine et al. | 49/349 |
| 2005/0274079 | A1 | 12/2005 | Chim | |
| 2006/0174543 | A1 * | 8/2006 | Rothe et al. | 49/352 |
| 2007/0006533 | A1 | 1/2007 | Dedrich et al. | |
| 2007/0277441 | A1 | 12/2007 | Smith et al. | |
| 2008/0236049 | A1 * | 10/2008 | Arimoto | 49/352 |

FOREIGN PATENT DOCUMENTS

EP 1816017 A1 8/2007

* cited by examiner

*Primary Examiner* — Katherine Mitchell
*Assistant Examiner* — Catherine A Kelly
(74) *Attorney, Agent, or Firm* — Millman IP

(57) ABSTRACT

In an embodiment an adjustable window regulator lifter plate assembly is provided. The adjustable window regulator lifter plate assembly includes a base, a window holder and a cross-car orientation adjustment mechanism. The base is configured for movement along a path. The base has an inboard side and an outboard side. The window holder is configured to receive and hold a vehicle window. The window holder is movably connected to the base. The cross-car orientation adjustment mechanism is operable by a cross-car orientation adjustment tool and is operatively connected to the window holder to control the cross-car orientation of the window holder. The cross-car orientation adjustment mechanism includes a cross-car orientation adjustment mechanism tool-receiving member configured to receive the cross-car orientation adjustment tool. The cross-car orientation adjustment mechanism tool-receiving member is accessible from the inboard side of the base.

5 Claims, 7 Drawing Sheets

ADJUSTABLE WINDOW REGULATOR LIFTER PLATE ASSEMBLY FOR A VEHICLE WINDOW

This application claims the benefit of U.S. Provisional Application No. 60/947,959, filed Jul. 4, 2007.

FIELD OF THE INVENTION

The present invention relates to adjustable window regulator lifter plates for vehicle windows, and more particularly to adjustable window regulator lifter plates for windows on a convertible.

BACKGROUND OF THE INVENTION

A door window in a vehicle is typically held by window regulator lifter plate assemblies within the door assembly. In certain types of vehicle, such as convertibles, there can be variation from vehicle to vehicle in the exact position of the roof and accordingly, there is variation in the required position of the top edge of the door window, in order to achieve a seal with the roof. Additionally, in vehicles such as convertibles, the vehicle door is typically frameless, which means that the vehicle door does not possess an upper portion with a guide track for the window. This adds to the problem because without a guide track, there will be some natural variation in the position of the top edge of the door window due simply to manufacturing tolerances in the door assembly and in any other relevant vehicle components.

To accommodate the aforementioned variation, vehicles may be manufactured with window regulator lifter plate assemblies that are adjustable so as to permit the position and orientation of the door window to be adjusted on each individual vehicle by an assembly line worker as necessary to provide the appropriate seal by the top edge of the window and the roof.

Some problems exist with some adjustable window regulator lifter plate assemblies that have been proposed. For example, some proposed window regulator lifter plate assemblies require access for adjustment from their outboard side, which is the side facing the exterior sheet metal of the vehicle door in which they are mounted. As a result, apertures are sometimes provided in the exterior sheet metal of the door to provide access. These apertures must then be covered by some suitable means, such as a polymeric plug, after use, which may detract visually from the appearance of the door, and which imposes an added complexity to the design and assembly of the vehicle.

Some other proposed window regulator lifter plate assemblies require access from the bottom edge of the vehicle door. In addition to necessitating the presence of an aperture to provide suitable access to the assembly, making an adjustment through an aperture on the bottom edge of the vehicle door can be cumbersome, Some other proposed window regulator lifter plate assemblies require a relatively large clearance in order to travel through their range of adjustability. This can sometimes be difficult to provide in the restrictive space in the interior of a door assembly.

SUMMARY OF THE INVENTION

In a first aspect, the invention is directed to an adjustable window regulator lifter plate assembly for a vehicle window that permits adjustment of the cross-car orientation of the vehicle window from the inboard side of the assembly.

In an embodiment of the first aspect, the adjustable window regulator lifter plate assembly includes a cross-car orientation adjustment mechanism that is operable by a cross-car orientation adjustment tool that includes a cross-car orientation adjustment mechanism tool-receiving member configured to receive the cross-car orientation adjustment tool. The cross-car orientation adjustment mechanism tool-receiving member is accessible from the inboard side of the base.

In a more particular embodiment of the first aspect, the adjustable window regulator lifter plate assembly includes a base, a window holder and a cross-car orientation adjustment mechanism. The base is configured for movement along a path. The base has an inboard side and an outboard side. The window holder is configured to receive and hold a vehicle window. The window holder is movably connected to the base. The cross-car orientation adjustment mechanism is operable by a cross-car orientation adjustment tool and is operatively connected to the window holder to control the cross-car orientation of the window holder. The cross-car orientation adjustment mechanism includes a cross-car orientation adjustment mechanism tool-receiving member configured to receive the cross-car orientation adjustment tool. The cross-car orientation adjustment mechanism tool-receiving member is accessible from the inboard side of the base.

The adjustable window regulator lifter plate assembly may include one or more additional adjustment mechanisms, such as, for example, a height adjustment mechanism. Any one or more of the additional adjustment mechanisms may be accessible from the inboard side of the base. In a particularly preferred embodiment, all of the adjustment mechanisms that are provided are accessible from the inboard side of the base. In another particularly preferred embodiment, the adjustable window regulator lifter plate assembly includes adjustability for cross-car orientation of the vehicle window, height of the vehicle window and fore/aft position of the vehicle window, all of which are accessible from the inboard side of the base.

In a second aspect, the invention is directed to an adjustable window regulator lifter plate assembly for a vehicle window. The adjustable window regulator lifter plate assembly includes a cross-car orientation adjustment mechanism for controlling the orientation of a vehicle window. The cross-car orientation adjustment mechanism adjusts the orientation of the vehicle window while requiring a relatively small operating clearance in the cross-car direction, relative to some lifter plate assemblies of the prior art.

In an embodiment of the second aspect, the adjustable window regulator lifter plate assembly includes a base and a window holder. The window holder is movably connected to the base. The window holder has a top and a bottom and is rotatable about an axis that is vertically spaced from the top, towards the bottom.

In a more particular embodiment of the second aspect, the adjustable window regulator lifter plate assembly includes a base and a window holder. The base is configured for movement along a path. The window holder is configured to receive and hold a vehicle window. The window holder is movably connected to the base. The window holder has a top and a bottom and is rotatable about a window holder rotation axis that is below the top.

In a third aspect, the invention is directed to an adjustable window regulator lifter plate assembly for a vehicle window. The adjustable window regulator lifter plate assembly includes a base, a window holder and a window fastener that holds the window holder to the base. The window holder is adjustable in its cross-car orientation relative to the base, while the window fastener holds the vehicle window in a generally fixed position to the window holder.

In an embodiment of the third aspect, the adjustable window regulator lifter plate assembly includes a base, a window holder and a window fastener. The window holder is movably connected to the base and is rotatable about a window holder rotation axis. The window fastener connects the window holder to the base and extends along a window fastener axis that generally intersects the window fastener axis.

In a more particular embodiment of the third aspect, the adjustable window regulator lifter plate assembly includes a base, a window holder and a window fastener. The base is configured for movement along a path. The window holder is configured to receive and hold a vehicle window. The window holder is movably connected to the base and is rotatable about a window holder rotation axis. The window fastener connects the window holder to the base and extends along a window fastener axis that generally intersects the window fastener axis.

In another aspect, the invention is directed to a window regulator assembly including at least one adjustable window regulator lifter plate assembly in accordance with any of the aspects or embodiments described above.

BRIEF DESCRIPTION OF THE DRAWINGS

The present invention will now be described by way of example only with reference to the attached drawings, in which.

DETAILED DESCRIPTION OF THE DRAWINGS

Figure 1:
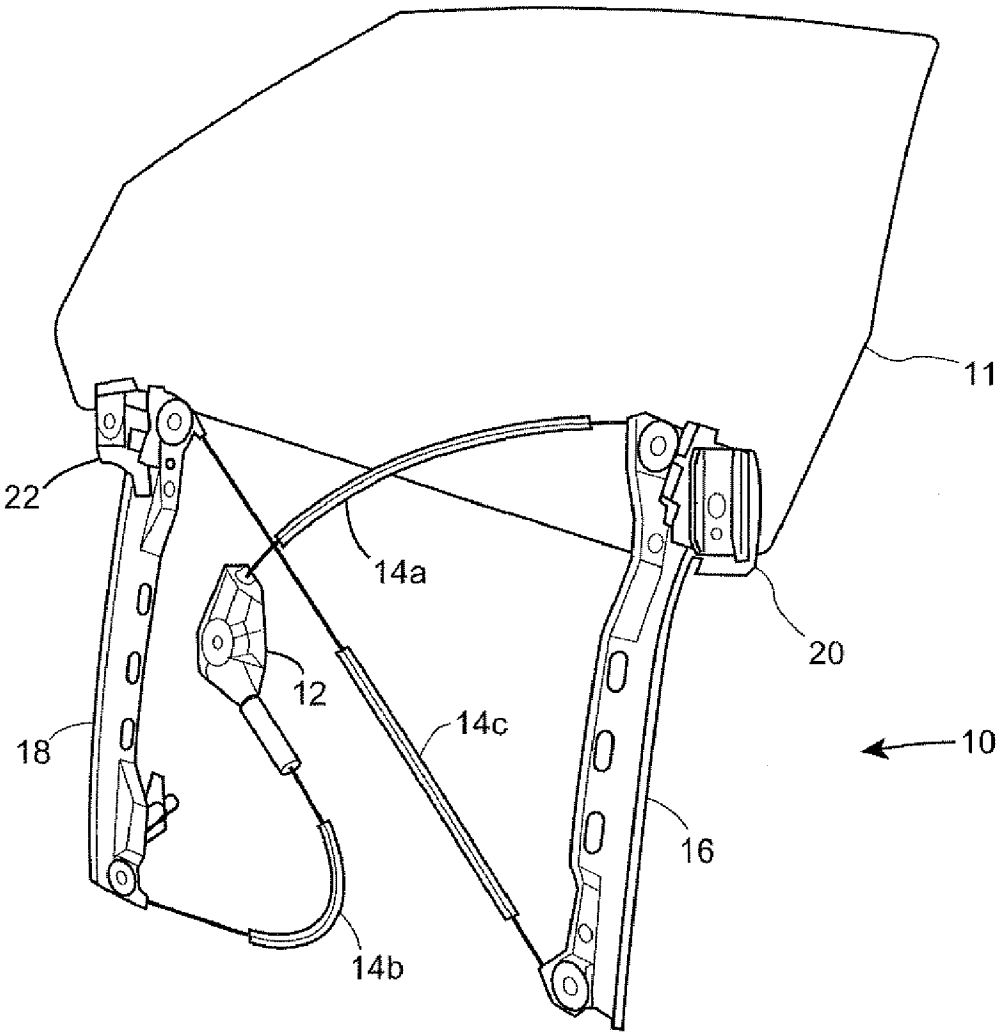
FIG. 1 is a perspective view of a window regulator assembly with a vehicle window, in accordance with an embodiment of the present invention.

Reference is made to FIG. 1, which shows a window regulator assembly 10 for moving a vehicle window 11 up and down, in accordance with an embodiment of the present invention. The window regulator assembly 10 may include a drive motor 12, a set of three drive cables 14*a*, 14*b* and 14*c*, a first rail 16, a second rail 18, a first window regulator lifter plate assembly 20 and a second window regulator lifter plate assembly 22.

The drive motor 12 is mountable to a carrier (not shown) or to some other suitable element of a door assembly. The drive motor 12 drives vertical movement of the first and second window regulator lifter plate assemblies 20 and 22 on the rails 16 and 18 respectively by means of the drive cables 14*a*, 14*b* and 14*c*.

Figure 2A:
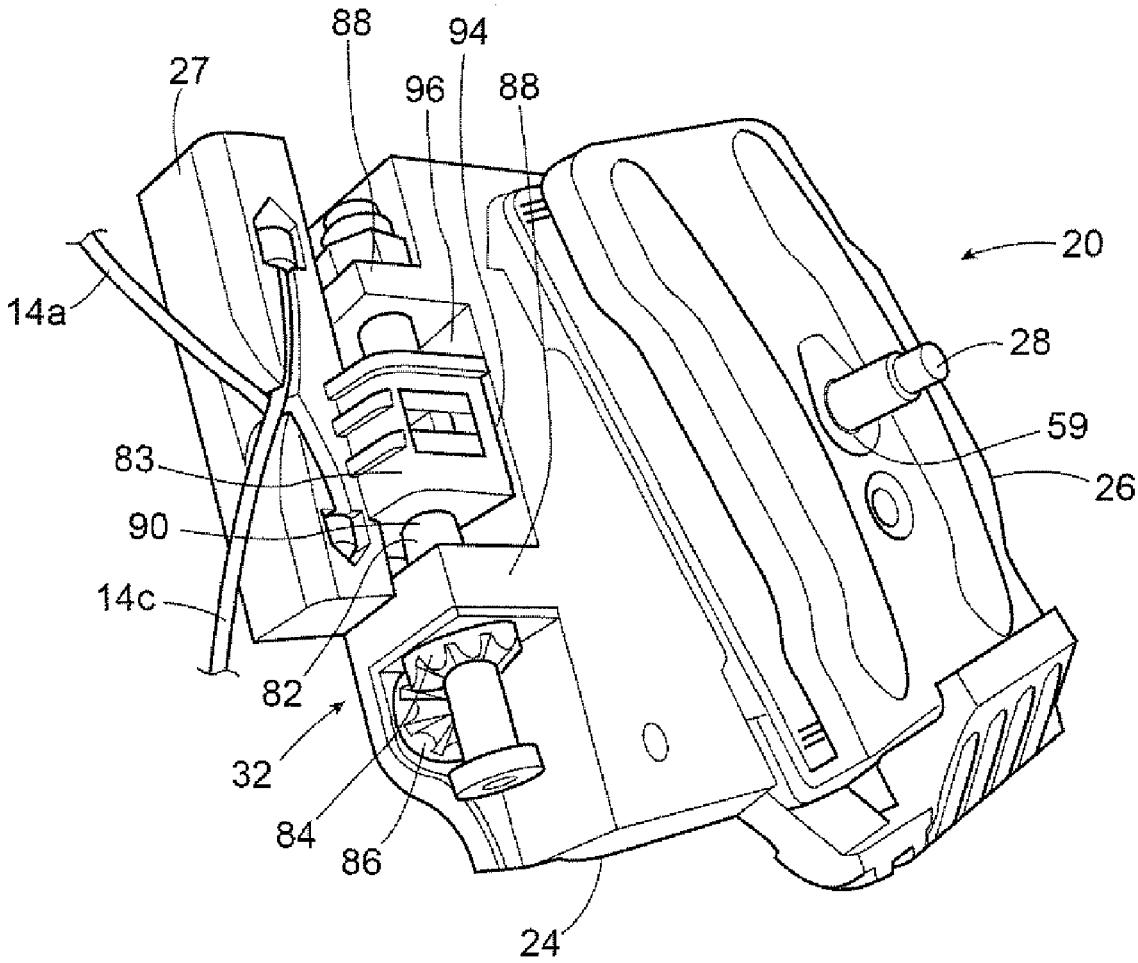
FIG. 2*a* is a magnified perspective view of a window regulator lifter plate assembly shown in FIG. 1.

The first and second window regulator lifter plate assemblies 20 and 22 are movably connected to the rails 16 and 18 respectively for vertical movement thereon along a path. Referring to FIG. 2*a*, the window regulator lifter plate assembly 20 includes a base 24, a window holder 26, a cable holder 27, a window fastener 28, a cross-car orientation adjustment mechanism 30 (FIG. 2*b*), a height adjustment mechanism 32 (FIG. 2*a*) and a fore/aft adjustment mechanism 34 (FIG. 2*b*).

Figure 2B:
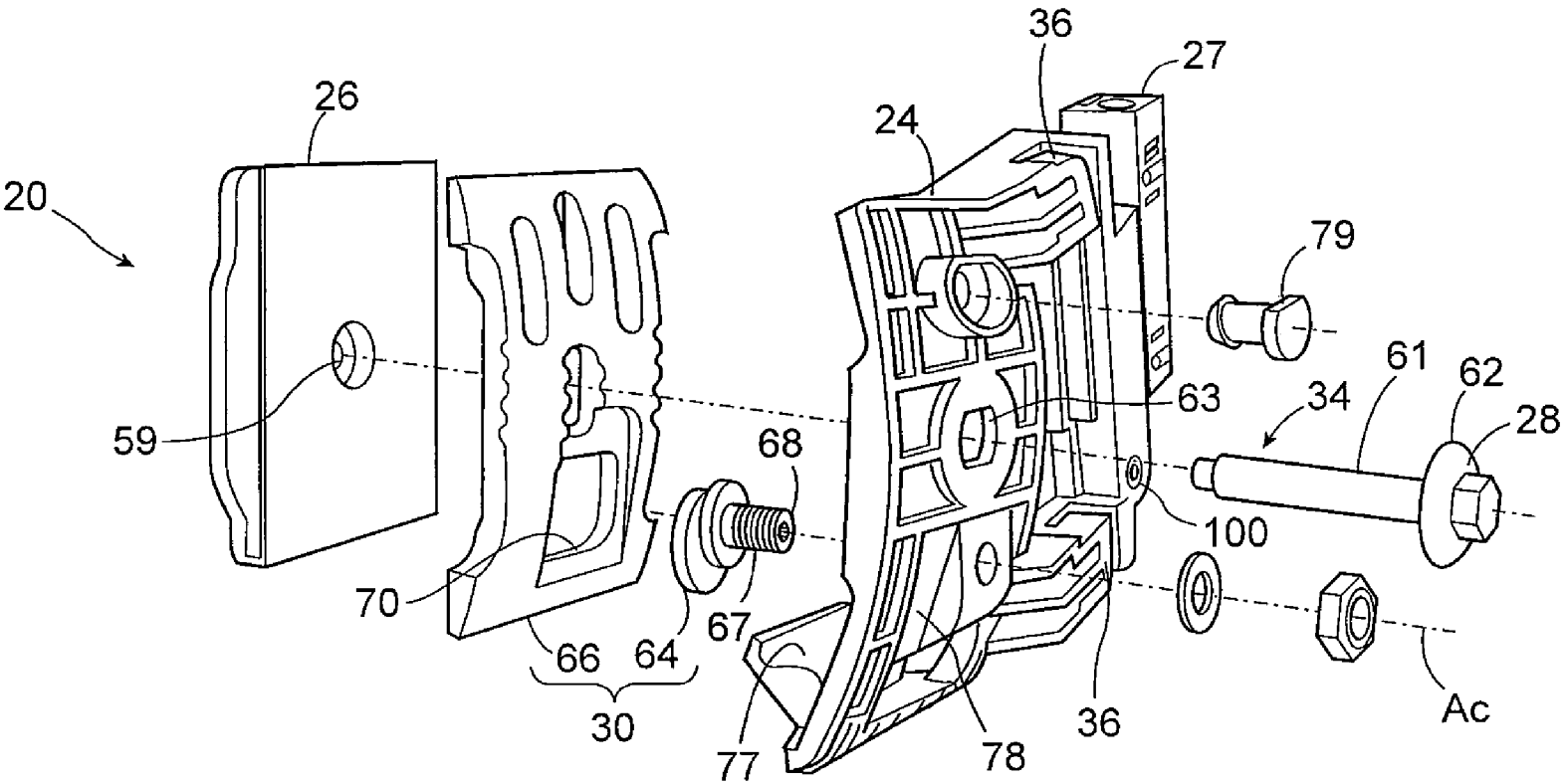
FIG. 2*b* is a magnified exploded, perspective of the window regulator lifter plate assembly shown in FIG. 2*a;*

Referring to FIG. 2*b*, the base 24 includes upper and lower rail guides 36 for mounting to the rail 16 (FIG. 1) while permitting sliding movement therewith. In this way, the base 24 is configured for movable association with the rail 16 (FIG. 1).

The configuration of the rail 16 (FIG. 1) and the rail guides 36 (FIG. 2*b*) may be any suitable configuration. For example, the engagement portion of the rail 16 (i.e. the portion of the rail 16 that is engaged by the rail guides 36) may be generally L-shaped in cross section, and the rail guides 36 (FIG. 2*b*) may have a generally L-shaped slot to accommodate the engagement portion of the rail 16. This substantially prevents the inadvertent disengagement of the base 24 from the rail 16.

The base 24 may be made from any suitable material or combination of materials, such as, for example, a combination of a metal, such as Aluminum, with a polymeric material for selected portions, such as the rail guides 36.

Figure 3A:
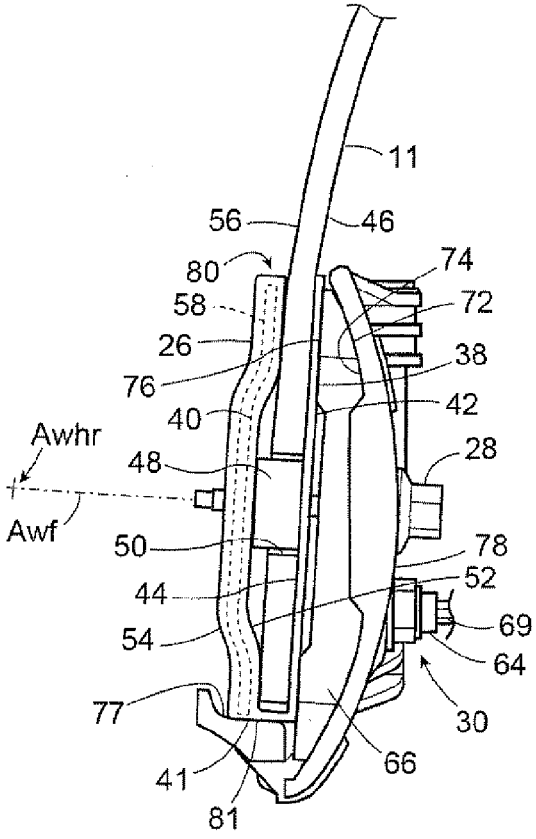
FIG. 3*a* is a magnified elevation view of the window regulator lifter plate assembly shown in FIG. 2*a*, in a first cross-car orientation.
Figure 3C:
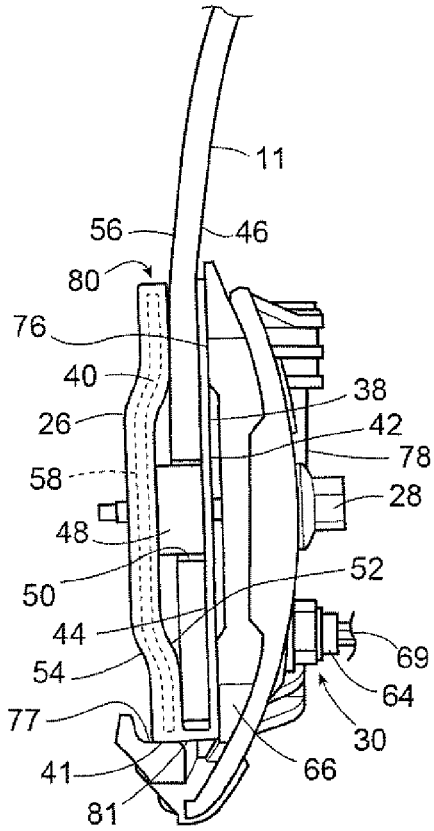
FIG. 3*c* is a magnified elevation view of the window regulator lifter plate assembly shown in FIG. 2*a*, in a third cross-car orientation.
Figure 3B:
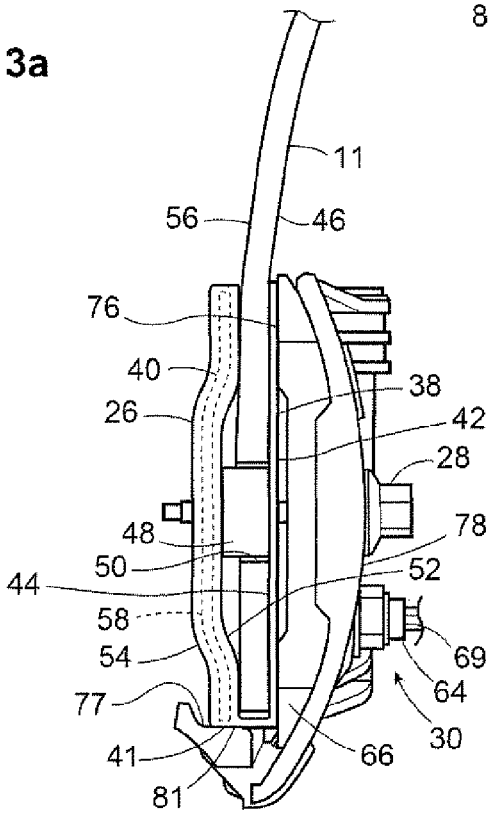
FIG. 3*b* is a magnified elevation view of the window regulator lifter plate assembly shown in FIG. 2*a*, in a second cross-car orientation.

Referring to FIGS. 3*a*, 3*b* and 3*c*, the window holder 26 receives and holds the vehicle window 11. In the embodiment shown in FIGS. 3*a*, 3*b* and 3*c* the window holder 26 is generally U-shaped and includes an inboard wall 38, an outboard wall 40, and a bottom wall 41. The inboard wall 38 has an inboard face shown at 42 and an outboard face shown at 44. The inboard face 42 slidingly engages a component of the cross-car orientation adjustment mechanism 30 and is preferably low-friction. The outboard face 44 engages the inboard face of the vehicle window 11, shown at 46. The inboard wall 38 further includes a window pass-through member 481 which passes through an aperture 50 in the vehicle window 11. The inboard wall 38 may include a suitable polymeric material on its inboard and outboard faces 42 and 44. The presence of the suitable polymeric material provides low friction engagement between the inboard face 42 and the cross-car-orientation adjustment mechanism 30. Additionally, the suitable polymeric material reduces the likelihood of damage to the vehicle window 11 from engagement with the inboard wall 38.

The outboard wall 40 has an inboard face shown at 52 and an outboard face shown at 54. The outboard wall 40 may include a suitable polymeric material on its inboard face 52 for engagement with the outboard face of the vehicle window 11, shown at 56. The outboard wall 40 may further include a reinforcement member 583 such as a metallic plate, which has a threaded aperture 59 therethrough, for receiving the window fastener 28, as described in further detail below for fixing the position of the window holder 26 relative to the base 24.

Referring to FIG. 2*b*, the window fastener 28 may include a bolt 61 and a washer 62 that may be integral with or separate from the bolt 61. The bolt 61 passes through an aperture 63 in the base 24, through an aperture in the inboard wall 36 of the window holder 26, and engages the threaded aperture 59 in the outboard wall 40 of the window holder 26. When securing the vehicle window 11 and the window holder 26 to the base 24, the window fastener 28 may be torqued to 8 Newton-meters.

Referring to FIG. 2*b*, the cross-car orientation adjustment mechanism 30 is used to adjust the cross-car orientation of the window holder 26, thereby adjusting the cross-car position of the top edge of the vehicle window 11. The cross-car orientation adjustment mechanism 30 includes a cross-car orientation adjustment cam 64 and a cross-car orientation adjustment cam follower 66. The cross-car orientation adjustment cam 64 includes a shaft 67 along its axis of rotation, shown at Ac. The shaft 67 includes at its end a tool-receiving member 68 for receiving a tool 69. The tool-receiving aperture 68 may be, for example, an Allen key aperture, and the tool may be, for example, an Allen key 69 (FIGS. 3*a*, 3*b* and 3*c*).

The cross-car orientation adjustment cam 64 engages a cam following surface 70 (FIG. 2*b*) on the cross-car orientation adjustment cam follower 66. As the cross-car orientation adjustment cam 64 rotates, the cross-car orientation adjustment cam follower 66 is urged upwards or downwards relative to the base 24.

Referring to FIG. 3*b*, the cross-car orientation adjustment cam follower 66 includes a base engagement surface 72 that is cylindrically arcuate. The base engagement surface 72 mates with and slidingly engages a cam follower engagement surface 74 on the base 24. The term 'cylindrically arcuate', as applied to the base engagement surface 72, means a surface that has the shape of a part cylinder. As the cross-car orientation adjustment cam follower 66 is urged upwards or downwards relative to the base 24, as shown in FIGS. 3*c* and 3*a* respectively, the engagement of the cylindrically arcuate base engagement surface 72 with the cam follower engagement surface 74 causes a rotational change in the orientation of the cam follower 66.

The cross-car orientation adjustment cam follower 66 includes a window holder engagement surface 76 that engages the inboard face 42 of the inboard wall 38 of the window holder 26. Any rotational change in the orientation of the cross-car orientation adjustment cam follower 66 causes a corresponding rotational change in the, orientation of the window holder 26. As a result of the slidability between the window holder 26 and the cross-car orientation adjustment cam follower 66, the assembly line worker (not shown) can keep the window holder 26 at a fixed vertical position, while adjusting the cam follower 66 upwards or downwards. For example, the assembly line worker may use his/her hands to hold the window holder 26 in position in abutment with a lip, shown at 77, that is connected to the base 24, during movement of the cross-car orientation adjustment cam follower 66. The presence of the lip 77 acts as a reference surface that permits the window holder 26 to be maintained at a known reference height in relation to the base 24 throughout the adjustment process.

The cross-car orientation adjustment cam 64 and the cross-car orientation adjustment cam follower 66 may be made from any suitable material, such as, for example, a metal, such as Aluminum.

It will be noted that the tool-receiving member 68 is accessible from the inboard side of the base 24, shown at 78. As a result, adjustment of the vehicle window 11 using the cross-car orientation adjustment mechanism 30 can be carried out relatively easily from the inboard side of the vehicle door (not shown) during vehicle assembly.

Referring to FIG. 2*b*, a retainer pin 79, having a head at one end and a split head at the other end, may extend through the base 24 and through a slotted aperture in the cross-car orientation adjustment cam follower 66 to retain the cross-car orientation adjustment cam follower 66 against the base 24 when the window fastener 28 is not in use holding the window holder 26 to the base 24.

The window holder 26 has a top 80 and a bottom 81. It will be noted that the center of rotation of the window holder 26 during a cross-car orientation adjustment is a window holder rotation axis Awhr (shown in FIG. 3*a*) that is vertically spaced from the top 80 of the window holder 26, towards the bottom 81. In the particular embodiment shown in FIGS. 3*a*, 3*b* and 3*c*, the window holder rotation axis Awhr is vertically midway between the top 80 and bottom 81. As a result of the window holder rotation axis Awhr being spaced from the top 80 towards the bottom 81, the window holder 26 goes through a relatively reduced overall angular change to achieve a given change in cross-car position for the top edge of the vehicle window 11, as compared to some prior art lifter plate assemblies that rotate the window holder about an axis proximate the top edge of the window holder. Thus, the overall operating clearance required for movement of the window holder 26 is reduced, which in turn facilitates its use in the restricted available space in some vehicle door assemblies.

Additionally, it will be noted that the axis of rotation Awhr of the window holder 26 intersects the axis Awf of the bolt 61 (FIG. 3*a*). This permits the bolt 61 to remain in a relatively tightened condition during a cross-car orientation adjustment. For example, in one embodiment, when effecting a cross-car window orientation adjustment, the torque on the bolt 61 is preferably at a torque of about 6 Newton-meters or less. The torque may thus be sufficiently high that the vehicle window 11 is held relatively tightly in the window holder 26. This is advantageous because the position of the vehicle window 11 does not significantly change after the cross-car orientation adjustment is carried out and the bolt 61 is tightened up to 8 Newton-meters of torque. By contrast, in some adjustment mechanisms of the prior art, the window fastener is loosened to the point where the vehicle window is only held loosely in the window holder (i.e. to the point where there is clearance between the window and the two walls of the window holder). As a result, the position of the window is susceptible to change when the window fastener is retightened. It will be understood that the window holder rotation axis Awhr need not precisely intersect the window fastener axis Awf. The advantage of the window fastener remaining relatively tight during a cross-car orientation adjustment can be achieved even if the window holder rotation axis Awhr generally intersects (i.e. is proximate to) the window fastener axis Awf.

Referring to FIG. 2*a*, the cable holder 27 is configured to hold the ends of the cables 14*a* and 14*c* (FIG. 2*a*). The height adjustment mechanism 32 is used to adjust the height of the cable holder 27 and the base 24 (and window holder 26) relative to each other. The cable holder 27 may be made from any suitable material, such as a suitable polymeric material with a backing made from a metal, such as Aluminum. The height adjustment mechanism 32 includes a threaded rod 82, a traveler 83, a first gear 84 and a second gear 86. The threaded rod 82 is rotatably supported in two spaced supports 88 on the base 24. The threaded rod 82 includes a threaded portion 90 between the supports 88. The threaded rod 82 may be made from a suitable material, such as a corrosion resistant steel. The traveler 83 includes an internally threaded portion 92 (FIG. 4) that engages the threaded portion 90 on the threaded rod 82. The traveler 83 further includes a rotation-prevention surface 94 that engages a corresponding surface 96 on the base 24 to prevent the rotation of the traveler 83 when the threaded rod 82 is itself rotated. Thus, when the threaded rod 82 is rotated, the traveler 83 travels along the threaded portion 90, thereby adjusting the vertical positions of the traveler 83 and the base 24 relative to each other.

Figure 4:
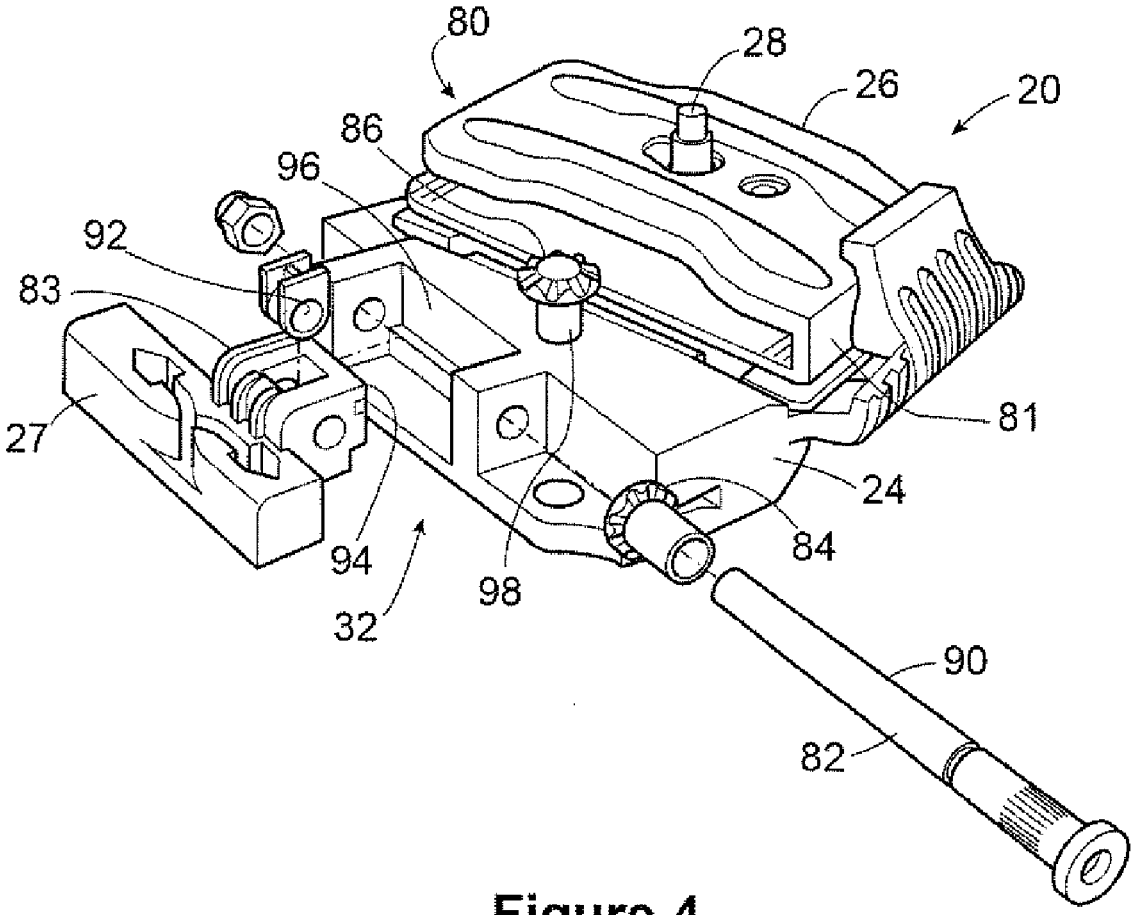
FIG. 4 is a magnified, exploded, perspective view of the window regulator lifter plate assembly shown in FIG. 2*a;*

In the embodiment shown in FIG. 4, the traveler 83 is itself connected to the cable holder 27, which, in use, holds the ends of the cables 14*a* and 14*c*, thereby keeping the cable holder 27 in a fixed position during a height adjustment, Thus, the traveler 83 actually remains stationary during a height adjustment while the base 24 moves up or down.

The traveler 83 may be made from any suitable material or combination of materials, such as a combination of metal and polymeric materials.

Figure 5:
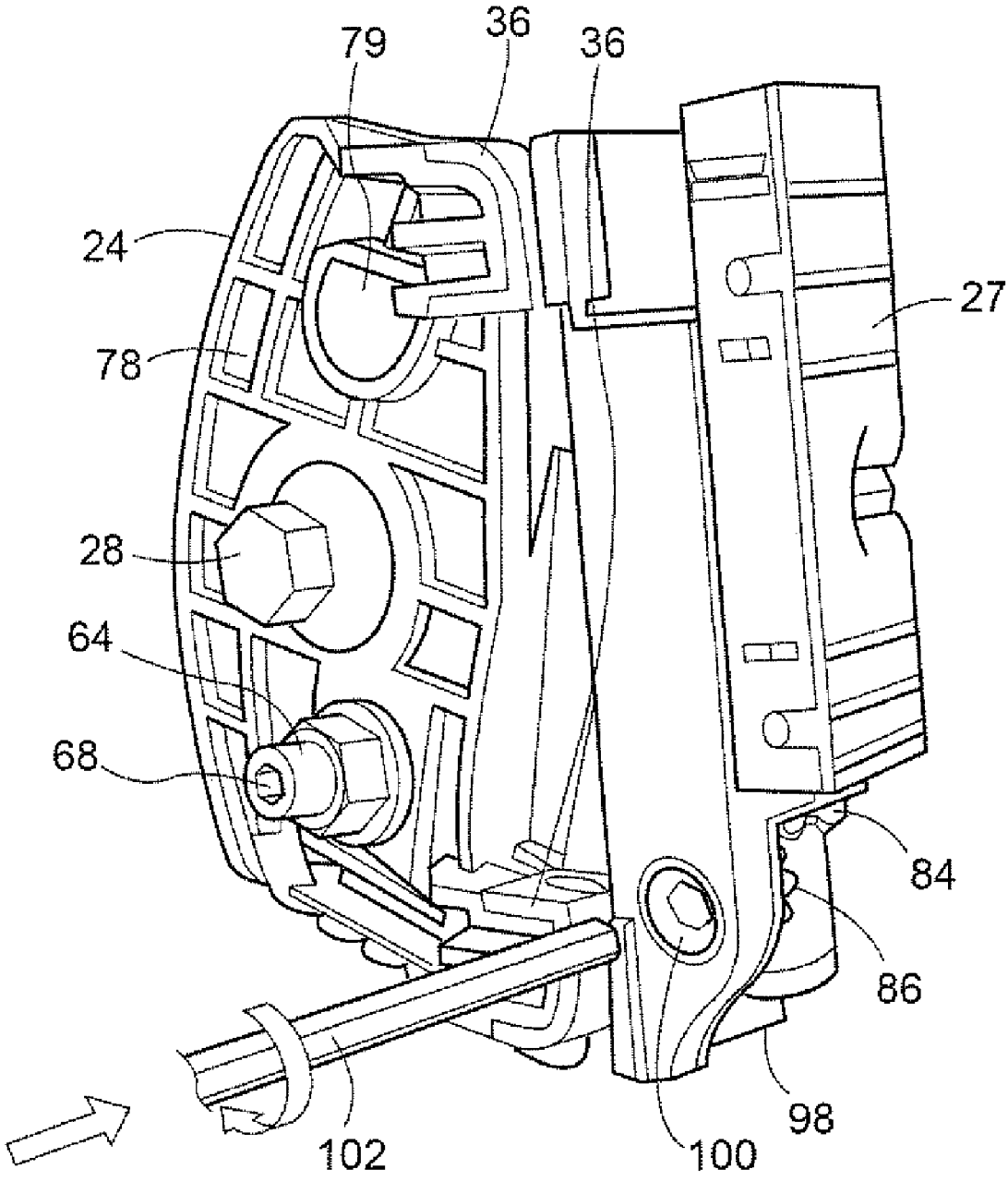
FIG. 5 is a perspective view of the window regulator lifter plate assembly shown in FIG. 2*a*, illustrating height adjustment.

The first gear 84 may be provided on an end of the threaded rod 82, and may be a bevel gear. The second gear 86 meshes with the first gear 84 and may also be a bevel gear, as shown in FIG. 2*a*. The second gear 86 includes a shaft 98 (FIG. 4) that passes through an aperture to the inboard side 78 (FIG. 5) of the base 24. The shaft 98 includes at its end a tool-receiving member 100 (FIG. 5), which is accessible from the inboard side 78 of the base 24. The tool-receiving member 100 receives a tool 102 which can be used to rotate the second bevel gear 86, which in turn rotates the first gear 84, which in turn causes movement of the traveler 83 on the threaded rod 82.

The tool-receiving member 100 may be configured to receive any suitable kind of tool. For example, the tool-receiving member 100 may be an Allen key aperture configured to receive an Allen key. Advantageously, the tool-receiving member 100 and the tool-receiving member 68 (FIG. 4) may be configured to receive the same tool, such as, for example, the same size of Allen key. This would permit the assembly line worker to make both the height adjustment and the cross-car orientation adjustment on the vehicle window 11 using the same tool, thereby saving time.

It will be noted that the window fastener 28 does not require loosening at all to effect a height adjustment of the vehicle window 11.

Figure 6:
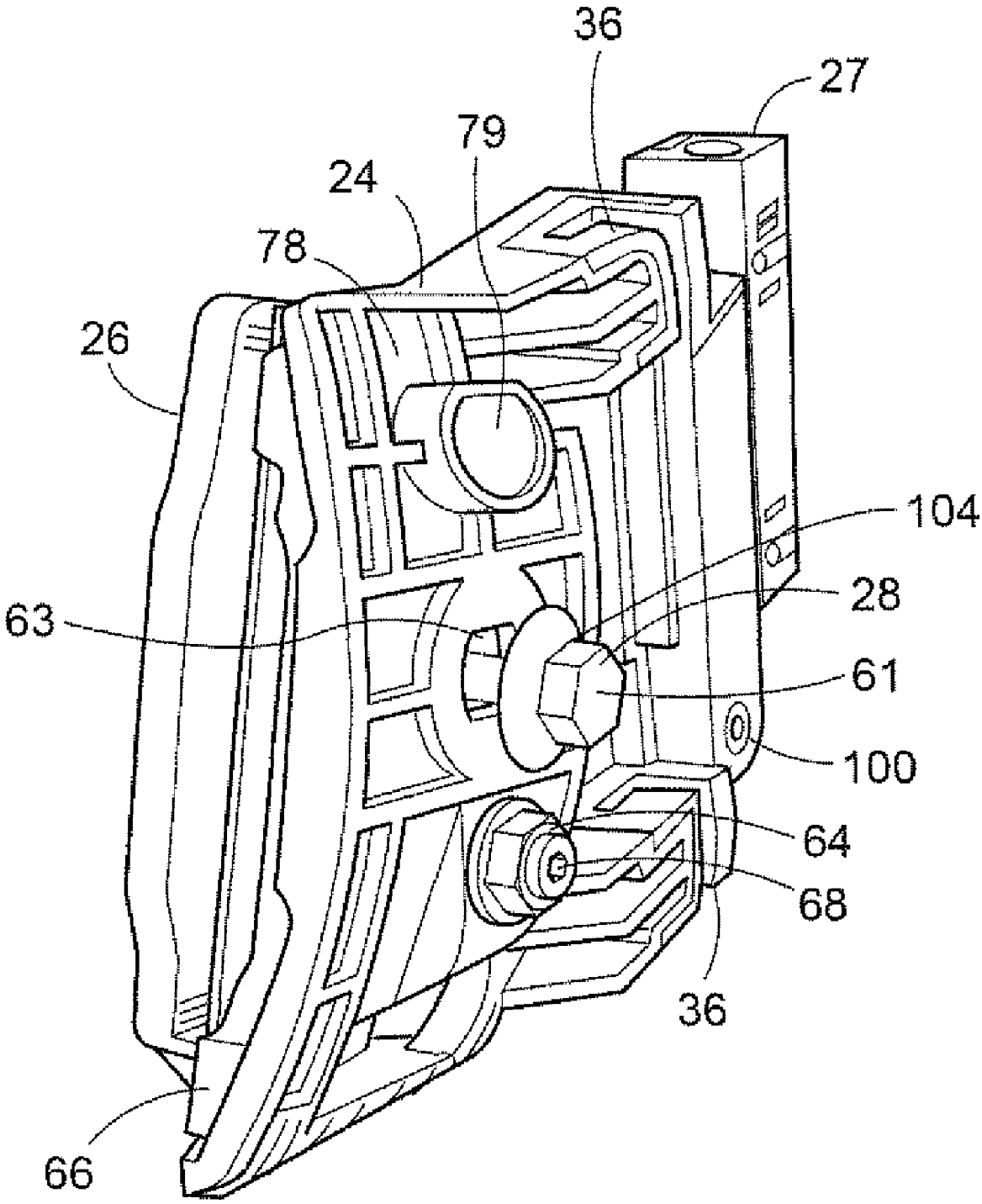
FIG. 6 is a perspective view of the window regulator lifter plate assembly shown in FIG. 2*a*, illustrating fore/aft adjustment.

Referring to FIG. 6, fore/aft adjustability for the window holder 26 may be provided using the window fastener 28. The pass-through aperture 63 in the base 24, through which the window fastener 28 passes, is made sufficiently large so that the bolt 61 can be adjusted fore and aft. The window holder 26, to which the window fastener 28 is attached, moves fore and aft along with the window fastener 28. In this way, the window fastener 28 and the pass-through aperture 63 in the base 24 together act as the fore/aft adjustment mechanism 34.

The bolt 61 has a head 106 that is a tool-receiving member. The head 104 may be any suitable kind of head, such as a hex-head, as shown in FIG. 6. The head 104 is exposed on the inboard side 78 of the base 24, and is therefore accessible by a suitable tool from the inboard side 78 of the base 24. Thus, all of the adjustments including the cross-car orientation adjustment, the height adjustment and the fore/aft adjustment can be made from the inboard side 78 of the base 24. Additionally, securing of the vehicle window 11 (FIG. 6) with the window fastener 28 is carried out from the inboard side 78 of the base 24.

Referring to FIG. 1, the window regulator lifter plate assembly 22 may be similar to the window regulator lifter plate assembly 20, but may be a mirror image thereof. Similarly, the rail 18 may be similar to the rail 16, but may be a mirror image thereof.

It has been described above that the window regulator 10 and the vehicle window 11 are mounted in a vehicle door (not shown). It will be understood that the window regulator 10 could be used with a vehicle window that is not door-mounted. For example, in convertibles, it is known to provide rear side windows aft of the vehicle door windows. These rear side windows retract into the body of the vehicle and not into the doors.

While the above description constitutes a plurality of embodiments of the present invention, it will be appreciated that the present invention is susceptible to further modification and change without departing from the fair meaning of the accompanying claims.

The invention claimed is:

1. An adjustable window regulator lifter plate assembly for a vehicle window having a top edge, comprising;

a base configured for movement along a path, wherein the base has an inboard side and an outboard side;

a cross-car orientation adjustment cam follower that moves along a path on the base, and has a cam following surface;

a window holder that is configured to receive and hold the vehicle window, wherein the window holder is movably connected to the cross-car orientation adjustment cam follower; and a cross-car orientation adjustment cam positioned to engage the cam following surface, wherein the cross-car orientation adjustment cam is rotatable to move the cross-car orientation adjustment cam follower along the path on the base, wherein movement of the cross-car orientation adjustment cam follower along the path on the base controls a cross-car orientation of the window holder, wherein the cross-car orientation adjustment cam is entirely inboard of the window holder and includes a shaft that passes through the base and has an end that has a tool receiving member that is accessible from the inboard side of the base, wherein the tool receiving member is engageable by a tool for causing rotation of the cross-car orientation adjustment cam; and a threaded bolt passing through an aperture in the base and an aperture in the cross-car orientation adjustment cam follower, the threaded bolt fastening the window holder to the base so as to sandwich the cross-car orientation adjustment cam follower between the base and the window holder; and a retainer pin passing through and connecting the cross-car orientation adjustment cam follower and the base so as to prevent the cross-car orientation adjustment cam follower from falling off the base when the threaded bolt is not present.

2. An adjustable window regulator lifter plate assembly as claimed in claim 1, wherein the window holder has a top and a bottom, and is rotatable by the cross-car orientation adjustment cam follower about an axis that is spaced from the top, of the window holder.

3. An adjustable window regulator lifter plate assembly as claimed in claim 1, further comprising:

a cable holder configured for holding drive cables from a window regulator, wherein the cable holder is movably connected to the base; and a height adjustment mechanism that is operable by a height adjustment tool to control vertical positions of the cable holder and the base relative to each other, wherein the height adjustment mechanism includes a height adjustment mechanism tool-receiving member configured to receive the height adjustment tool, wherein the height adjustment mechanism tool-receiving member is accessible from the inboard side of the base.

4. An adjustable window regulator lifter plate assembly as claimed in claim 3, wherein the adjustment cam tool-receiving member and the height adjustment mechanism tool-receiving member are configured to receive the same tool.

5. A window regulator assembly, comprising:

a drive motor;

a set of drive cables;

at least one rail; and at least one adjustable window regulator lifter plate assembly for a vehicle window having a top edge, comprising:

a base configured for movement along the at least one rail, wherein the base has an inboard side and an outboard side, wherein the drive motor is operatively connected to the base by the drive cables;

a cross-car orientation adjustment cam follower that moves along a path on the base, and has a cam following surface;

a window holder that is configured to receive and hold the vehicle window, wherein the window holder is movably connected to the cross-car orientation adjustment cam follower;

a cross-car orientation adjustment cam positioned to engage the cam following surface, wherein the cross-car orientation adjustment cam is rotatable to move the cross-car orientation adjustment cam follower along the path on the base, wherein movement of the cross-car orientation adjustment cam follower along the path on the base controls a cross-car orientation of the window holder, wherein the cross-car orientation adjustment cam is entirely inboard of the window holder and includes a shaft that passes through the base and has an end that has a tool receiving member that is accessible from the inboard side of the base, wherein the tool receiving member is engageable by a tool for causing rotation of the cross-car orientation adjustment cam; and a threaded bolt passing through an aperture in the base and an aperture in the cross-car orientation adjustment cam follower, the threaded bolt fastening the window holder to the base so as to sandwich the cross-car orientation adjustment cam follower between the base and the window holder; and a retainer pin passing through and connecting the cross-car orientation adjustment cam follower and the base so as to prevent the cross-car orientation adjustment cam follower from falling off the base when the threaded bolt is not present.

* * * * *